US008500609B1

(12) United States Patent
Williams

(10) Patent No.: US 8,500,609 B1
(45) Date of Patent: Aug. 6, 2013

(54) ATTACHABLE WEIGHT ASSEMBLY FOR A POLE

(76) Inventor: Andrea Williams, Hanover, NH (US)

( * ) Notice: Subject to any disclaimer, the term of this patent is extended or adjusted under 35 U.S.C. 154(b) by 249 days.

(21) Appl. No.: 13/019,968

(22) Filed: Feb. 2, 2011

Related U.S. Application Data

(60) Provisional application No. 61/456,095, filed on Nov. 1, 2010.

(51) Int. Cl.

| | |
|---|---|
| ***A63B 21/072*** | (2006.01) |
| ***A45B 3/00*** | (2006.01) |
| *A45B 7/00* | (2006.01) |
| *A61H 3/00* | (2006.01) |
| *A63B 69/18* | (2006.01) |
| *A63C 11/22* | (2006.01) |

(52) U.S. Cl.
USPC ..... 482/108; 482/51; 482/70; 482/74; 482/93; 482/109; 135/65; 280/819

(58) Field of Classification Search
USPC ..... 482/44, 49, 50, 70, 74, 92, 93, 97, 482/98, 106–109; 473/256, 437; 135/65, 135/66; 280/816, 819; 16/422, 426
See application file for complete search history.

(56) References Cited

U.S. PATENT DOCUMENTS

| | | | | | |
|---|---|---|---|---|---|
| 3,834,697 | A * | 9/1974 | McNamara et al. | ..... | 473/256 |
| 4,017,070 | A * | 4/1977 | Hilton | ..... | 482/18 |
| 4,588,191 | A * | 5/1986 | Stewart | ..... | 473/256 |
| 4,688,788 | A * | 8/1987 | Olufs | ..... | 482/66 |
| 4,756,524 | A * | 7/1988 | Cooney | ..... | 482/71 |
| 5,064,190 | A * | 11/1991 | Holt | ..... | 482/70 |
| 5,415,607 | A * | 5/1995 | Carpenter | ..... | 482/106 |
| 5,460,378 | A * | 10/1995 | Getts | ..... | 473/251 |
| 5,778,914 | A * | 7/1998 | Trani | ..... | 135/66 |
| 5,788,608 | A * | 8/1998 | Wilkinson | ..... | 482/51 |
| 6,083,116 | A * | 7/2000 | Loredo | ..... | 473/256 |
| 6,120,385 | A * | 9/2000 | Nemeckay | ..... | 473/256 |
| 7,588,500 | B2 * | 9/2009 | Hoeckl et al. | ..... | 473/256 |
| 2002/0128085 | A1 * | 9/2002 | Kallassy | ..... | 473/256 |
| 2009/0258765 | A1 * | 10/2009 | Panicali | ..... | 482/106 |

FOREIGN PATENT DOCUMENTS

| | | | |
|---|---|---|---|
| DE | 102004041634 | A1 * | 3/2006 |
| DE | 202006013876 | U1 * | 12/2006 |
| DE | 102010034511 | A1 * | 2/2012 |
| DE | 202011050492 | U1 * | 11/2012 |
| GB | 2229934 | A * | 10/1990 |

* cited by examiner

*Primary Examiner* — Loan Thanh
*Assistant Examiner* — Victor K Hwang
(74) *Attorney, Agent, or Firm* — Michael Diaz

(57) ABSTRACT

An attachable weight assembly having separable sections for attachment to a pole used in exercising. The weight assembly includes a elongated main body having a first end and a second end and a bore running through the first end, second end and elongated main body. The bore is sized to fit over a shaft. The first and second ends each have a storage area for secure storage of a molded weight. The elongated main body is separable into at least two main body sections. The main body sections are attached together using an attachment mechanism. A user attaches the weight assembly to the shaft for use during exercise.

17 Claims, 6 Drawing Sheets

ATTACHABLE WEIGHT ASSEMBLY FOR A POLE

RELATED APPLICATIONS

This utility application claims the benefit of U.S. Provisional Patent Application Ser. No. 61/456,095 filed Nov. 1, 2010 and is hereby incorporated by reference.

BACKGROUND OF THE INVENTION

1. Field of the Invention

This invention relates to exercise devices. Specifically, and not by way of limitation, the present invention relates to a dumbbell weight assembly attachable to a pole.

2. Description of the Related Art

With the ever increasing sedentary life of people in the modern world, it has become important for individuals to maintain an exercise regime to maintain their health. There are a wide variety of ways to exercise. One type of exercise which has become very popular is Nordic walking. Nordic walking is fitness walking utilizing specially designed poles. This type of exercise has evolved from an off-season ski-training activity, which is also known as ski walking, hill bounding or ski striding. It has become a way of exercising year-round. Ski walking and hill bounding with poles has been practiced for decades as dry land training for competitive Nordic skiers. In addition, hikers with knee pain discovered they could walk with more power by using a pair of trekking poles, which often eliminates or reduces pain to hip, ankles, knees, feet and backs. Nordic walking involves the individual applying force to the poles with each stride. These Nordic walkers use more of their entire body and at a greater intensity which is not normally present in normal walking. Nordic walking includes the benefits of increased overall strength and endurance in the core muscles and the entire upper body of the Nordic walker. In addition, balance and stability are improved by using the poles.

In another aspect, lightweight hand weights are frequently used during exercise to improve strength and endurance while toning and shaping muscles. Repetitive motion with lightweight hand weights is an excellent blend of muscle endurance work and cardio-respiratory activity. Addition of hand weights while working the upper body increases aerobic exercise and caloric expenditure.

Benefits of aerobic training include increasing endurance, boosting High-density lipoprotein (HDL) cholesterol, helping to control blood pressure, bone strengthening, helping to maintain normal body weight and improving one's sense of wellbeing.

It would be advantageous to have an apparatus which combines the benefits of Nordic walking with hand weights. It is an object of the present invention to provide such an apparatus.

SUMMARY OF THE INVENTION

The present invention is an attachable weight assembly having separable sections for attachment to a pole used in exercising. In one aspect, the present invention is directed to a weight assembly attachable to a shaft. The weight assembly includes a elongated main body having a first end and a second end and a bore running through the first end, second end and elongated main body. The bore is sized to fit over a shaft. The first and second ends each have a storage area for secure storage of a molded weight. The elongated main body is separable into at least two main body sections. The main body sections are attached together using an attachment mechanism. A user attaches the weight assembly to the shaft for use during exercise.

In another aspect, the present invention is directed to an exercise system using a weight assembly attached to a shaft. The system includes a shaft of a component of any exercise equipment. The system also includes an elongated main body having a first end and a second end and a bore running through the first end, second end and elongated main body. The bore is sized to snugly fit over the shaft. In addition, the first and second ends each having a storage area and a molded weight insertable into the storage area. The elongated main body is separable into at least two main body sections. The main body sections are attached together using an attachment mechanism. A user attaches the weight assembly to the shaft for use during exercise. The shaft may be a pole used in Nordic walking.

DESCRIPTION OF THE INVENTION

Figures 1A, 1B:
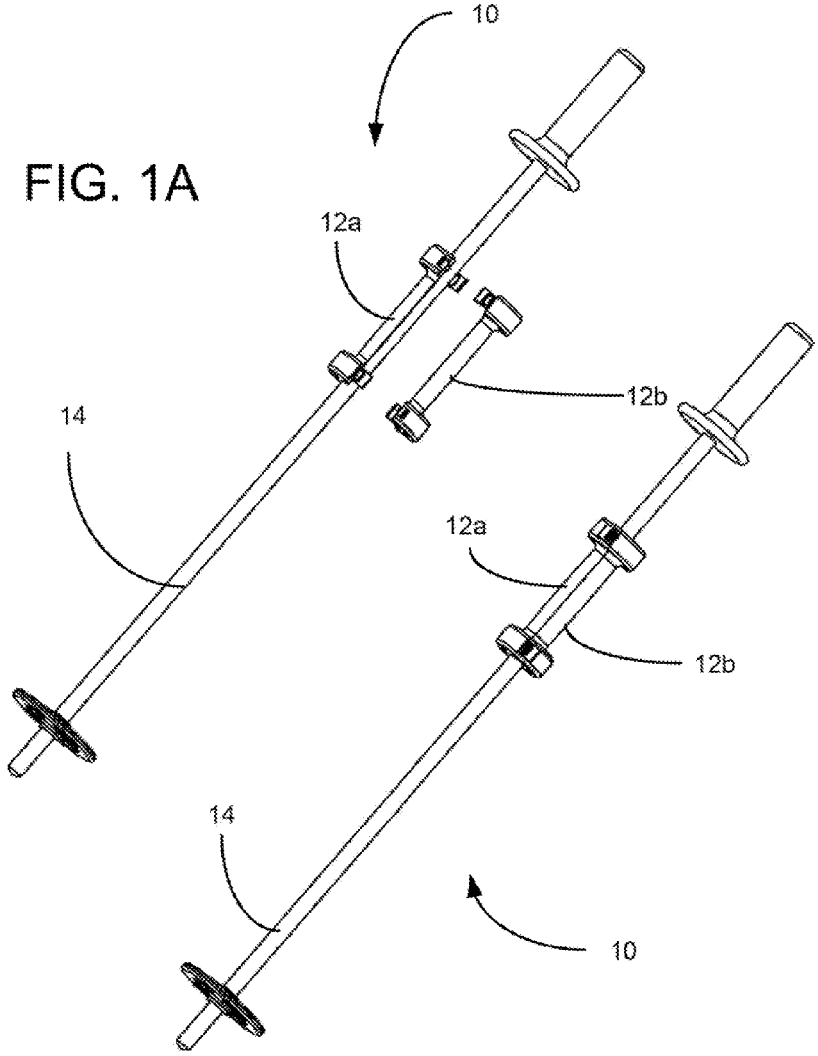
FIGS. 1A and 1B are front views of the attachable dumbbell weight assembly in one embodiment of the present invention.

The present invention is an attachable weight assembly for a pole. The present invention is an attachable dumbbell weight assembly 10 which adds a light hand weight to athletic poles, thereby increasing the aerobic workout of the user. The attachable dumbbell weight is added to the shaft of a pole used for hiking, snowshoes, skiing, etc. FIGS. 1A and 1B are front views of the attachable dumbbell weight assembly 10 in one embodiment of the present invention. The attachable dumbbell weight assembly 10 includes a two piece dumbbell weight having opposing half sections 12*a* and 12*b*. FIG. 1A illustrates the half section 12*a* attached to a shaft 14 and the half section 12*b* detached from the shaft 14. FIG. 1B illustrates the half sections 12*a* and 12*b* attached to the shaft 14. The shaft may be any cylindrical or oblong shaped object. However, in the preferred embodiment of the present invention, the shaft is an exercise pole such as used in Nordic walking.

Figure 2:
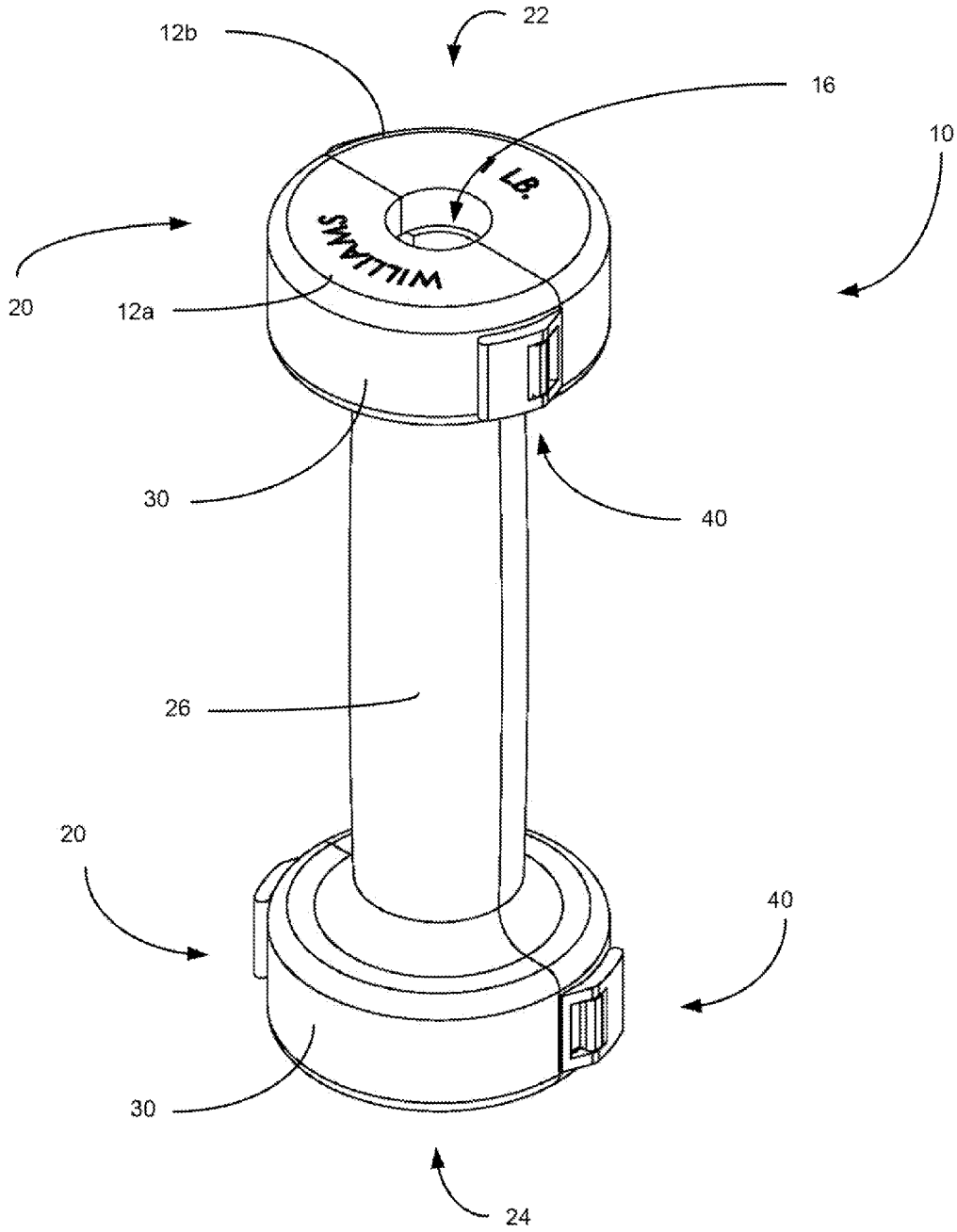
FIG. 2 is a front perspective view of the dumbbell weight assembly of FIG. 1 in a closed configuration.
Figure 3:
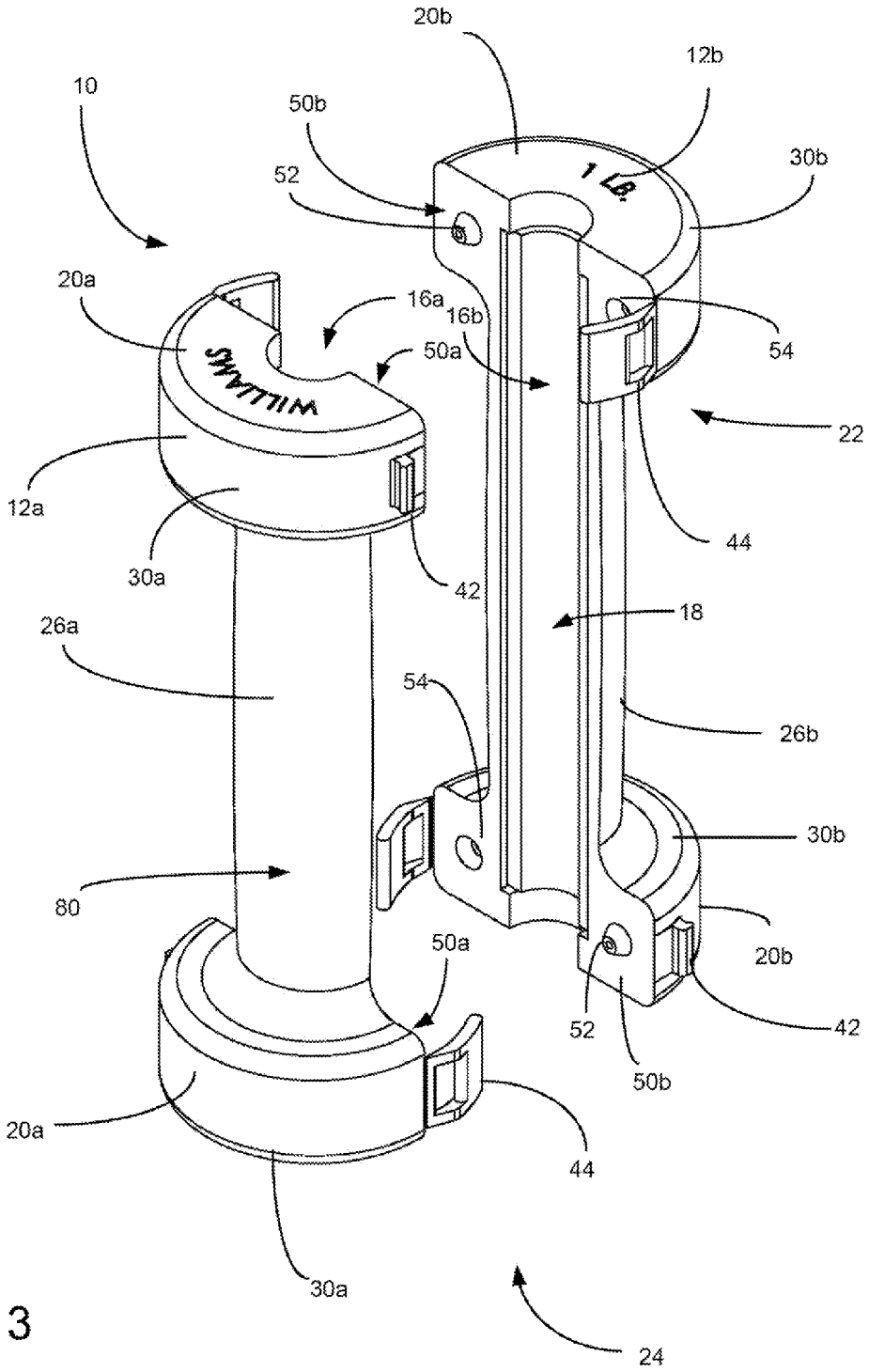
FIG. 3 is a front perspective view of the dumbbell weight assembly in an open configuration with the half section separated from an opposing half section.

FIG. 2 is a front perspective view of the dumbbell weight assembly 10 of FIG. 1 in a closed configuration. FIG. 3 is a front perspective view of the dumbbell weight assembly 10 in an open configuration with the half section 12*a* separated from the half section 12*b*. When configured in the closed position (with half section 12*a* attached to the half section 12*b*), a central bore 16 is formed. The central bore is size and shaped to securely fit around the shaft 14. The central bore 16 includes a bore half 16*a* and bore half 16*b* which may be lined with a nonslip compression material 18. The dumbbell weight assembly 10 includes distal weight protrusions 20 located in each end 22 and 24 of an elongated section 26. The weight protrusion 20 includes protrusion half 20*a* and 20*b*. The elongated section 26 includes an elongated section half 26*a* and an elongated section half 26*b*. The distal dumbbell weight protrusions 20 on each end of the dumbbell weight assembly 10 may include an insertable molded weight 30 having weight sections 30*a* and 30*b*, which may vary in weight. The weight sections are sized and shaped to fit within the protrusion halves 20*a* and 20*b*. Although, the protrusion 20 is illustrated as circular, the weight protrusion 20 may be any shape (e.g., octagonal, square, etc.).

Figure 4C:
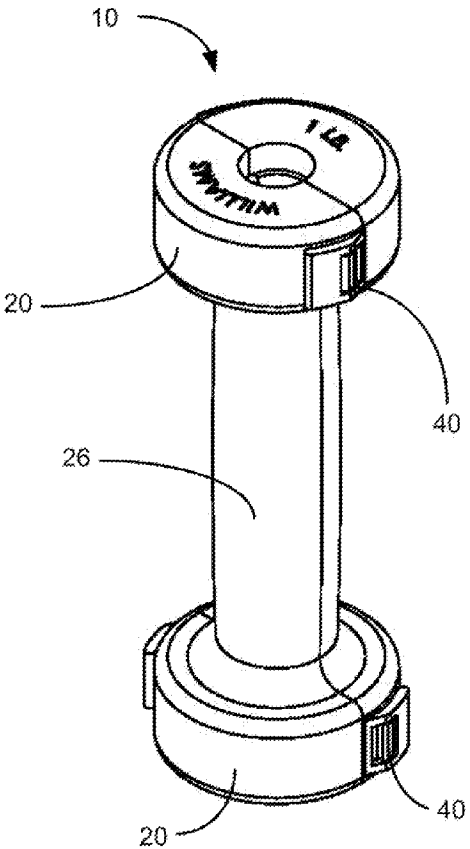
FIG. 4C is a top perspective view of the dumbbell weight assembly.
Figure 4B:
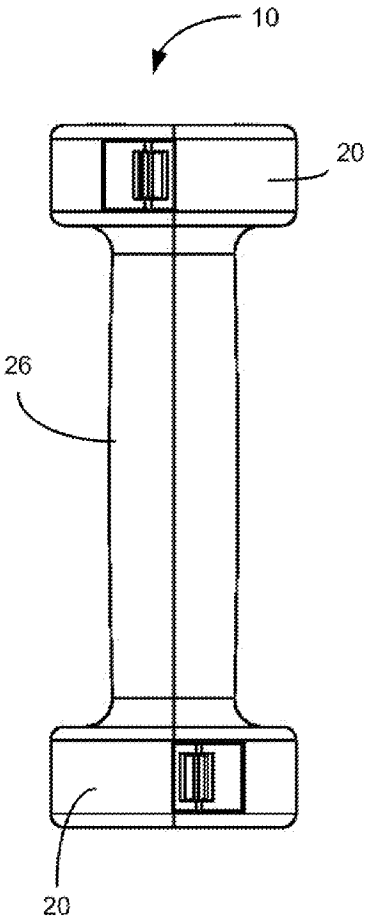
FIG. 4B is an opposite side view from FIG. 4A of the dumbbell weight assembly.
Figure 4A:
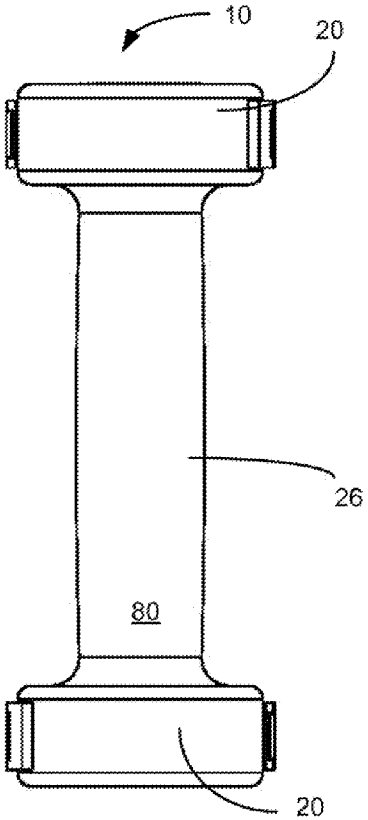
FIG. 4A is a side view of the dumbbell weight assembly.

FIG. 4A is a side view of the dumbbell weight assembly 10. FIG. 4B is an opposite side view from FIG. 4A of the dumbbell weight assembly 10. FIG. 4C is a top perspective view of the dumbbell weight assembly 10. The half sections 12*a* and 12*b* are held together by attachment mechanisms. The present invention may utilize any clamp or attachment mechanism, such as a living hinge, hook and pile strips, ski boot type closure devices, etc. As illustrated in FIGS. 2 and 3, the dumbbell weight assembly 10 utilizes a living hinge clamp mechanism 40. The living hinge clamp mechanism 40 includes a receiving member 42 located on one weight protrusion half and a extension member 44 located on an opposing weight protrusion half. The extension member 44 may be coupled to its opposing receiving member 42 and locked in place in a similar fashion found in fastening ski boots to a person's foot. In one embodiment, inner surfaces 50*a* and 50*b* of the weight protrusions 20*a* and 20*b* include a male to female connection to the opposite mirrored half, creating a stronger closure. As depicted, a male coupling member 52 is located on one inner surface (e.g., inner surface 50*b*) and a female coupling member 54 is located on an opposing inner surface (e.g., inner surface 50*a*). The male coupling member may include a protrusion which is sized and shaped to fit within the female coupling member 54 forming an indentation to receive the male coupling member. In alternate embodiments, the attachment mechanism (e.g., living hinge mechanism) may be located anywhere on the dumbbell weight assembly 10, such as the elongated section halves 26*a* and 26*b*.

Figure 5A:
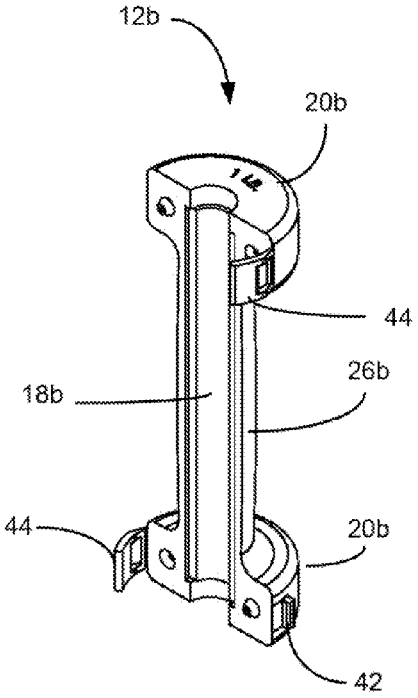
FIG. 5A is a front perspective view of a fully assembled half section.
Figure 5B:
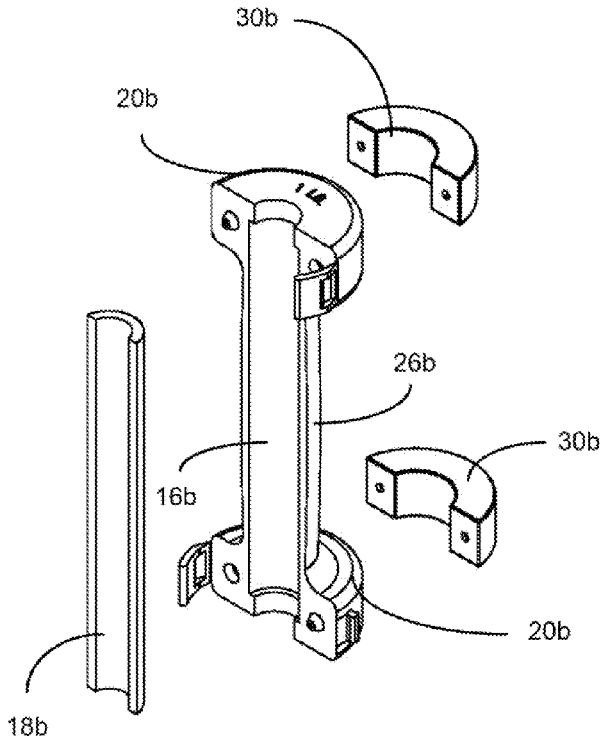
FIG. 5B is a front perspective view of a disassembled half section.

FIG. 5A is a front perspective view of a fully assembled half section 12*b*. FIG. 5B is a front perspective view of a disassembled half section 12*b*. The nonslip compression material 18 may be constructed of separate grip sections. FIGS. 5A and 5B depict one of the grip sections, section 18*b*. Each grip section is sized and shaped to fit within half of the central bore 16 (i.e., bore half 16*b*). The grip section may be removable. The grip, when located within the mirrored halves 12*a* and 12*b*, creates a tight nonslip closure around the shaft 14. Each grip section (e.g., 18*b*) is removable and may vary in thickness to accommodate varying diameters of different shafts, which insures a nonslip closure of the dumbbell weight assembly 10. As depicted in FIG. 58, the weight halves 30*a* and 30*b* may be fixed or removable. Removable weight halves 30*a* and 30*b* enable the insertable molded weights 30 to be replaced, thereby allowing heavier or lighter weights to be inserted to vary the weight, which enables a user to set the resistance and strength building level during movement. Alternatively, different weight amounts may be inserted as a fixed molded weight in 30*a* and 30*b* i.e. 1 or 2 pound weights so that a user may purchase a set of 1 or 2 pound weights. The exterior surface 80 of the elongated hand grip may contain grooves, contours, knurled or padding to more ergonomically fit to the user's hand.

Figure 6A:
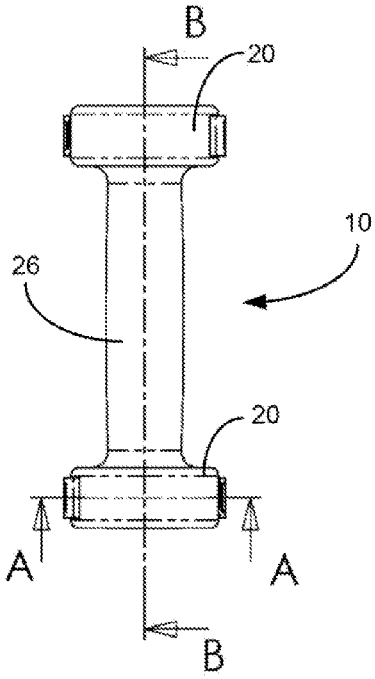
FIG. 6A is a side view of the dumbbell weight assembly.
Figure 6B:
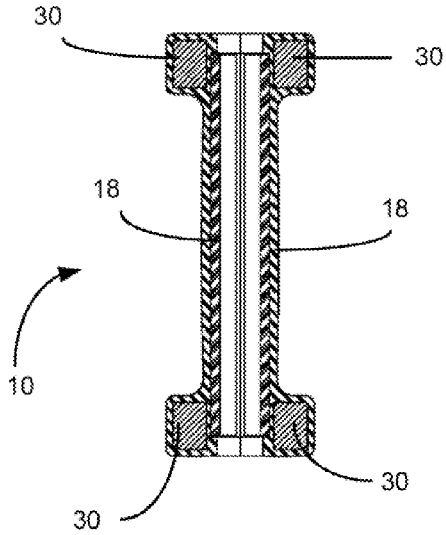
FIG. 6B is a cross sectional view of the dumbbell weight assembly along a line B.
Figure 6C:
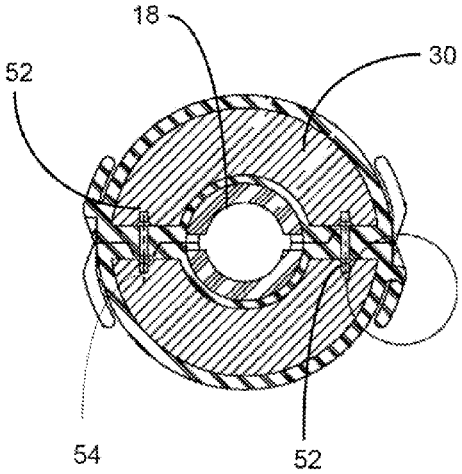
FIG. 6C is a cross sectional view of the dumbbell weight assembly along a line A.
Figure 6D:
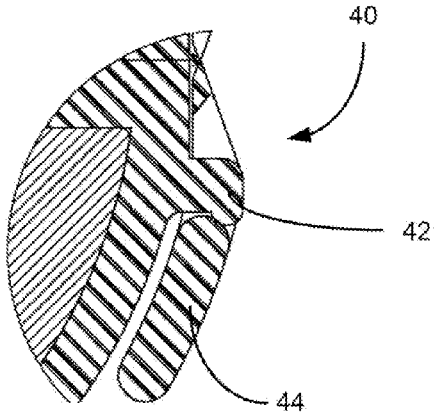
FIG. 6D is an enlarged cross sectional view of the clamp assembly of the dumbbell weight assembly.

FIG. 6A is a side view of the dumbbell weight assembly 10. FIG. 6B is a cross sectional view of the dumbbell weight assembly 10 along a line B. FIG. 6B illustrates the insertable molded weight 30 and the compression material 18. FIG. 6C is a cross sectional view of the dumbbell weight assembly 10 along a line A. FIG. 6C illustrates the insertable molded weight 30, the compression grip material 18, the male coupling member 52 and the female coupling member 54. FIG. 6D is an enlarged cross sectional view of the clamp assembly 40 of the dumbbell weight assembly 10. FIG. 6D illustrates the receiving member 42 and the extension member 44.

Each half of the dumbbell weight assembly 10 is clamped together to form an attachable weight to an athletic pole, such as a ski, hiking, or snowshoe pole. In addition, the clamped weight may be used separately as a hand weight. The mirrored half design creates an ease in manufacturing and simple design modality.

The weight may be attached anywhere along the shaft 14 as determined by the user's desire for resistance training and pole balance. The athletic pole (shaft 14) may be gripped at the proximal end and used in the usual fashion for hiking, snowshoeing, skiing, etc. as the distal end strikes the ground. The attachable dumbbell weight preferably includes the nonslip material located in the bore 16 to prevent slippage of the weight on the athletic pole. The athletic pole may also be grasped on the grip of the attachable dumbbell weight which may be placed in the proximal to midshaft pole region. The pole may then be carried using the attachable dumbbell weight. The pole is preferably carried using and up and down pumping motion of the arms. Increasing the intensity of the pumping motion increases the cardiovascular workout using a high repetition low weight hand weight. Additionally, the attachable dumbbell weight may be used alone as a hand weight during walking or other exercises, providing a low weight high repetition endurance workout.

With reference to FIGS. 1-6, the operation of the dumbbell weight assembly 10 will now be explained. As illustrated in FIG. 3, the half sections 12*a* and 12*b* are separated. The desired weight amount is inserted into the dumbbell weight assembly 10 by inserting the insertable molded weight halves 30*a* and 30*b* into the weight protrusions halves 20*a* and 20*b*. Alternatively, precast molded weights 30*a* and 30*b* may already be inserted into 20*a* and 20*b*. The half sections are position on the desired region of the shaft 14. The bore halves 16*a* and 16*b* are positioned against an outer surface of the shaft 14. The half sections 12*a* and 12*b* are held together by the clamp mechanism 40 whereby the extension member 44 is fit within the receiving member 42 and locked in place. The male coupling member 52 engages its corresponding female coupling member 54. Furthermore, the nonslip compression material 18 prevents the weight assembly 10 from sliding up or down the shaft 14 when locked in place. With the dumbbell weight assembly 10 securely in place, the user may use the shaft (pole) to exercise with additional weight added to the pole.

The dumbbell weight assembly may be constructed of any rigid material, such as plastic, steel, or composite material. In alternate embodiments of the present invention, the molded weights 30 may be liquids, granular solids or any other substance which may fill a hollow section within the protrusions 20. It should be understood that any mechanism which changes the amount of weight on the weight assembly may be utilized and still remain in the scope of the present invention. Furthermore, the attachable weight may be applied to any shaft and used in many different applications, such as golf clubs, hockey sticks, fishing poles, bicycle frame tubes, canoe/kayak paddles, etc. In another aspect, the attachable weight may be used for physical rehabilitation patients and/or older people. The weight may be attached to canes, walkers, etc to add a low weight, repetition physical therapy. Furthermore, although the present invention is discussed using two sections, any number of sections may be utilized which allow the weight to be attached to the shaft. In addition, the attachable weight may assume different shapes to adhere to exercise equipment in the most ergonomically and aerodynamically efficient manner and to conform to varying shapes, tapers, and sizes of exercise equipment shafts.

The present invention provides versatility in low weight high repetition endurance training. The present invention provides a simple and easy way of adding weight to a shaft of a pole or other exercise equipment. Furthermore, the weight assembly may be modified to allow different weights to be applied to a shaft. In addition, the present invention provides a secure fastening of the weight assembly to the shaft.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A weight assembly attachable to a shaft, the weight assembly comprising:

an elongated main body having a first end and a second end;

a bore running through the first end, second end and elongated main body, wherein the bore is sized to fit over the shaft;

the first and second ends each having a storage area;

at least one removable and interchangeable molded weight sized and shaped to fit in the storage area;

wherein the elongated main body comprises at least two separable main body sections, wherein each of the first end and the second end comprise at least two separable end sections, and each storage area of the first and second ends comprise at least two storage sections;

means for attaching the main body sections together;

whereby the main body is secured to the shaft for use during exercise.

2. The weight assembly according to claim 1 wherein the means to attach the main body sections together is a living hinge.

3. The weight assembly according to claim 2 wherein the living hinge includes a receiving member coupled to an extension member.

4. The weight assembly according to claim 1 wherein the means to attach the main body sections together is a clamp mechanism.

5. The weight assembly according to claim 1 wherein the bore is lined with a nonslip compression material.

6. The weight assembly according to claim 1 wherein the bore includes a detachable insert sized and shaped to fit within the bore and secure the weight assembly to the shaft.

7. The weight assembly according to claim 6 wherein the insert is separable into two insert sections.

8. The weight assembly according to claim 7 wherein each separable end section includes an inner wall.

9. The weight assembly according to claim 8 wherein a male female coupling mechanism is affixed to each inner wall to secure opposing end sections together.

10. The weight assembly according to claim 1 wherein an exterior surface of the elongated main body is contoured to fit a user's hand.

11. The weight assembly according to claim 1 wherein the first and second ends are circular.

12. An exercise system using a weight assembly attached to a shaft, the system comprising:

a shaft of exercise equipment;

an elongated main body having a first end and a second end;

a bore running through the first end, second end and elongated main body, wherein the bore is sized to fit over the shaft;

the first and second ends each having a storage area;

at least one removable and interchangeable molded weight sized and shaped to fit in the storage area;

wherein the elongated main body comprises at least two separable main body sections, wherein each of the first end and the second end comprise at least two separable end sections, and each storage area of the first and second ends comprise at least two storage sections;

means for attaching the main body sections together;

whereby the main body is secured to the shaft for use during exercise.

13. The exercise system according to claim 12 wherein the shaft is a pole.

14. The exercise system according to claim 13 wherein the pole is a Nordic walking pole.

15. The exercise system according to claim 12 wherein the means to attach the main body sections together is a clamp mechanism.

16. The exercise system according to claim 12 wherein the bore is lined with a nonslip compression material.

17. The exercise system according to claim 12 wherein the first and second ends are circular.

* * * * *